United States Patent [19]

Wormser

[11] Patent Number: 5,067,179

[45] Date of Patent: Nov. 26, 1991

[54] CONVERTIBLE GARMENT LEG CONSTRUCTION

[75] Inventor: Walter S. Wormser, Highland Park, Ill.

[73] Assignee: The Wormser Company, Northbrook, Ill.

[21] Appl. No.: 609,411

[22] Filed: Nov. 5, 1990

[51] Int. Cl.[5] ..... A41D 10/00; A41D 27/10

[52] U.S. Cl. ..... 2/269; 2/83; 2/239; 2/270

[58] Field of Search ..... 2/269, 270, 83, 80, 2/111, 239, 232, 114

[56] References Cited

U.S. PATENT DOCUMENTS

| | | | |
|---|---|---|---|
| 569,483 | 10/1896 | Arnold | 2/83 |
| 1,112,759 | 10/1914 | Bissell et al. | 2/83 |
| 1,183,792 | 5/1916 | Aron | 2/270 |
| 1,283,205 | 10/1918 | Jones | 2/83 |
| 1,365,526 | 1/1921 | Milkes | 2/270 |
| 1,393,900 | 10/1921 | Milkes | 2/83 |
| 2,274,510 | 2/1942 | Wohl et al. | 2/270 |
| 2,497,262 | 2/1950 | Jacobson | 2/270 |
| 2,546,057 | 3/1951 | Bodin et al. | 2/270 |
| 2,655,660 | 10/1953 | Racz | 2/83 |
| 2,677,130 | 5/1954 | O'Hayer | 2/270 |
| 2,705,326 | 4/1955 | Lahnstein et al. | 2/269 |
| 2,775,771 | 1/1957 | Heilbronner | 2/270 |
| 3,111,676 | 11/1963 | Artzt et al. | 2/270 |
| 3,201,800 | 8/1965 | McHugh | 2/83 |
| 3,329,972 | 7/1967 | Schwab et al. | 2/270 |
| 3,381,311 | 5/1968 | Wormser | 2/270 |
| 4,475,253 | 10/1984 | Laveckis | 2/269 |

OTHER PUBLICATIONS

Gershman, Maurice, "Self-Adhering Nylon Tapes," *Journal of AMA*, vol. 168, No. 7, Oct. 18, 1958.

*Primary Examiner*—Werner H. Schroeder
*Assistant Examiner*—Amy Brooke Vanatta
*Attorney, Agent, or Firm*—Welsh & Katz, Ltd.

[57] ABSTRACT

A child's convertible pajama leg construction is provided which selectively serves either as a neat anklet hugging sleeve or as a sock-like enclosure for protecting the child's foot. The ankle sleeve is defined by two elongated panels joined along longitudinal seams and being circumferentially stretchable, with one panel having a manipulatable cuff formed thereon and arranged in one position to hug the sleeve and in another position to serve as a closure for the sock. Fastener elements for a hook-and-loop type of fastener assembly are positioned on the panels and the cuff in various locations to enable a preschool child to manipulate the panels and the cuff to expose the child's foot to the atmosphere or to confine the foot into the sock-like enclosure without the assistance of an older person.

27 Claims, 2 Drawing Sheets

CONVERTIBLE GARMENT LEG CONSTRUCTION

BACKGROUND OF THE INVENTION

This invention relates to a convertible garment leg construction for pajamas and the like, and more particularly, it relates to an improved pajama leg construction which permits the selective manipulation of the leg construction so that the foot of the wearer will be either exposed or covered.

It is desirable that bed clothes for children, such as pajamas, be provided with foot covering portions which may be selectively used for foot protection in very cold weather, or when children are ill and are to be protected from cold floors and from chilling, or that may be selectively used without the foot covering portions in warm weather so that the foot is exposed. This broad concept and idea generally is not new, but a simple, practical and inexpensive construction has not yet been found or commercialized which enables a small child to easily manipulate the leg construction from the exposed foot condition to the covered foot condition, and vice versa, without the assistance of an older person. Thus, prior to the invention herein, regular pajamas for children above the age of infants, but below the age of kindergarten admission, normally have not provided such a feature.

Thus, the principal object of this invention is to provide an improved, convertible, pajama leg construction which permits the selective use of the leg construction either as ordinary pajamas or as pajamas provided with a sock-like enclosure for protecting the foot of the wearer, and wherein the improved pajama leg construction is characterized by simplicity and inexpensiveness of construction, by attractiveness of appearance, and by ease of manipulation by a preschool child.

Another object of this invention is to provide a simple sleeve construction for the lower portion of a pajama leg, with a manipulatable cuff on said sleeve, by means of which is provided a convertible pajama leg construction that is inexpensive to construct, is effective in operation, and is attractive in appearance.

These and other objects of the invention, as well as the advantages thereof, will be made more clear in the description which follows.

SUMMARY OF THE INVENTION

The foregoing objects are achieved by the provision of a convertible garment leg construction which is suitable for use in a small child's pajamas, which comprises a garment leg having an upper open end merged into the crotch and seat portion of a fabric garment, and having a lower open end spaced from the upper open end. The garment leg further has an elongated front fabric panel with side edges and an elongated rear fabric panel with side edges, and a length sufficient to provide a foot receiving sock element when the garment leg is extended to its full length. An elongated fabric cuff is provided on the lower open end of the garment leg and positioned across the rear panel, the cuff having an upper cuff edge above the lower open end of the garment leg, and having a lower cuff edge fold below the lower open end. A hook-and-loop type of fastener unit is provided which has a first fastener element containing a plurality of loops and a second fastener element containing a plurality of hooks for grippingly engaging the loops. One of the fastener elements is mounted on the front panel of the garment leg and the other one of the fastener elements is mounted on the cuff. The mounting of the two fastener elements is made in locations sufficient to provide that the wearer of the garment may manipulate the front panel and the cuff to bring the two fastener elements into gripping engagement to close off the lower open end of the garment leg and provide the foot receiving sock element.

In a further embodiment of the present invention, the convertible garment leg construction as described hereinabove further includes an elongated tubular fabric sleeve having an upper open end attached to the lower open end of the garment leg and having a lower open end spaced from the sleeve upper open end. In this embodiment, it is the tubular fabric sleeve which has the elongated front fabric panel and elongated rear fabric panel, and it is also the tubular fabric sleeve which has a length sufficient to provide a foot receiving sock element when the sleeve is extended to its full length. The elongated fabric cuff is mounted on the sleeve lower open end across the rear panel of the sleeve, and the cuff has an upper cuff edge positioned above the sleeve lower open end, as well as a lower cuff edge fold located below the sleeve lower open end.

In an additional embodiment, the convertible garment-like construction of the foregoing paragraph further includes the cuff extended across the outside surface of the sleeve rear panel, with one fastener element mounted on the outside surface of the sleeve front panel proximate the sleeve lower open end, and the other one of the fastener elements is mounted on the outside surface of the cuff proximate to the upper cuff edge. The cuff is manipulatable for inversion into a sleeve-closing position where the cuff extends across the sleeve lower open end to close off the sleeve opening and the first and second fastener elements are brought into gripping engagement.

In an alternate embodiment, the convertible garment leg construction has the cuff located at least partially within the tubular fabric sleeve, and extended across the inside surface of the sleeve rear panel. One fastener element is mounted on the inside surface of the sleeve front panel proximate the sleeve lower open end, and the other one of said fastener elements is mounted on the outside surface of the cuff proximate the upper cuff edge. The front panel and the cuff are manipulatable for closing the sleeve open end by bringing the first and second fastener elements into gripping engagement. When the gripping engagement of the fastener elements occurs, the inside of the cuff becomes a foot receiving pocket for the toes and forward portion of the foot of the child who is wearing the pajama bottoms.

A clear understanding of these and other embodiments of the present invention will be obtained from the disclosure which follows, when read in light of the accompanying drawings.

DESCRIPTION OF THE PREFERRED EMBODIMENTS

Figure 1:
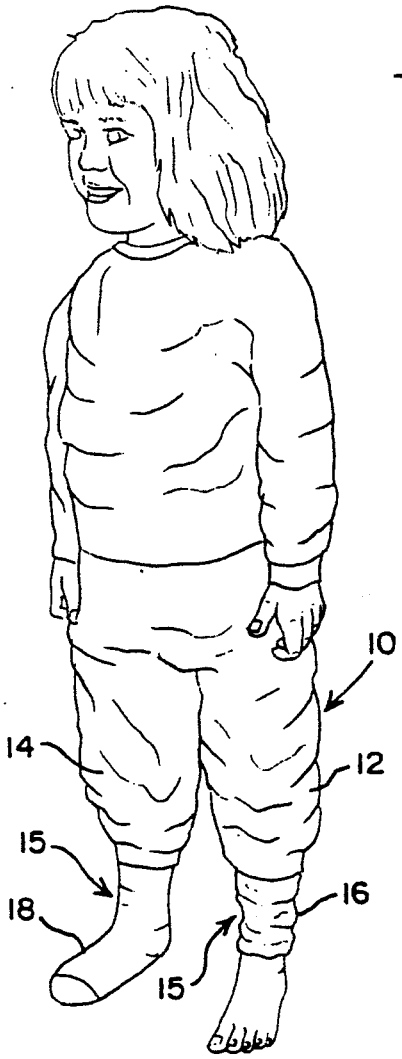
FIG. 1 is an illustration of a preschool child wearing a set of pajamas which includes the convertible garment leg construction of the present invention, and showing the foot construction both when the convertible leg construction operates to enclose the child's foot and when it operates to expose the foot to the open atmosphere.

Referring now to the drawings, there is shown in FIG. 1 a child wearing a pajama garment that is generally indicated at 10, and which is provided with the improved convertible leg construction of this invention. The garment 10 in FIG. 1 includes pajama legs 12 and 14, respectively, for the left and right legs, and at the lower end of each pajama leg there is generally shown at 15 the convertible leg construction of this invention. The child's left leg is shown with the convertible leg portion 15 in the form of an anklet cuffing 16, and the right leg 14 is shown with the convertible leg portion 15 in position to serve as a foot receiving sock 18. It can be seen that the anklet cuffing 16 is foreshortened by shirring the fabric of the convertible leg portion 15 into a plurality of circumferential folds or accordion-like pleats, above the ankle of the child, while the foot receiving sock 18 is formed by extending convertible leg portion 15 to a length sufficient to completely cover the foot of the child.

Figure 2:
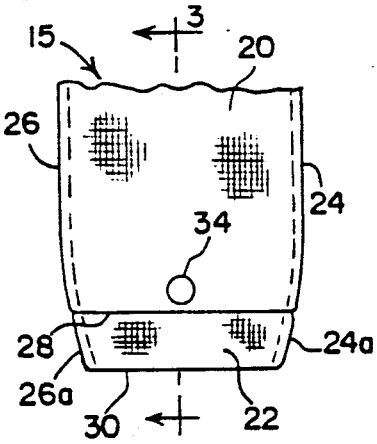
FIG. 2 is a simplified schematic front elevational view of the lower portion of the left pajama leg of FIG. 1, showing the bottom of the tubular sleeve in a relatively flat and extended configuration with an open end for exposing the child's foot to the atmosphere.
Figure 3:
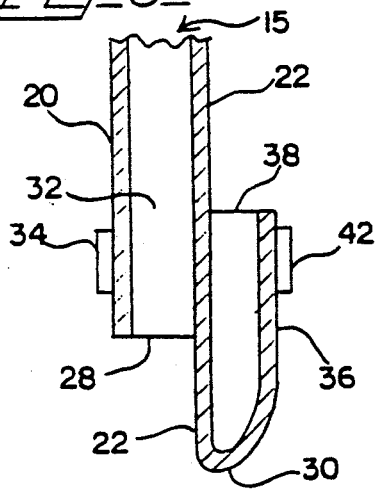
FIG. 3 is a simplified schematic cross-sectional elevational view of the convertible leg construction of FIG. 2, taken along the section line 3—3.

The condition of the lower end of the convertible leg portion 15 when it is attached to serve as a cuffed anklet 16 is shown in FIGS. 2 and 3. The convertible leg portion 15 generally constitutes an elongated tubular sleeve of a fabric material that is circumferentially stretchable in a direction transverse of the longitudinal axis of the sleeve, and the upper tubular end of elongated sleeve 15 is attached thereat to the lower end of the pajama leg construction in a conventional manner well known in the art. Although a nonstretchable fabric may be used in accordance with this invention, the defined stretchable fabric is preferred.

Referring now to FIGS. 2 and 3, the lower end of leg construction 15 is shown to be formed of two elongated pieces of material, one serving as a front piece or panel 20 and the other serving as a back piece or panel 22. These pieces of material are secured to each other along their longitudinal edges by oppositely arranged seams 24 and 26 to thereby provide an interior space 32 within the resulting sleeve 15. The lower free terminus of the front member 20 is indicated at 28 and the lower free terminus of the back piece 22 is indicated at 30. The back panel 22 is of a length such that its terminus 30 is located at a level below terminus 28 of the front panel. The lengths of piece 20 and piece 22 are so selected that the sleeve 15 defined thereby may be shirred or accordion-pleated to serve as the anklet sleeve as indicated at 16 of FIG. 1, or may be extended to define the foot enclosing sock 18 as seen in FIG. 1.

The front panel 20 is provided with a fastening element, such as element 34, attached to the front piece 20 at a point substantially midway between the seams 24 and 26. The back panel 22 is retroverted exteriorly to define an elongated cuff 36 located outwardly of panel 22 and which is of a length to have its longitudinal ends secured to, and extended between, the seams 24 and 26. The height, or width, of the cuff 36 extends from the fold line 30 at the free terminus of back piece 22 to an upper free edge 38 which is spaced above the level of the fastener 34, as can best be seen in FIG. 3.

The cuff 36 is also provided with a fastener element 42 adjacent the upper free edge 38 and located about half way between the seams 24 and 26. Fastener element 42 is also located substantially the same distance from fold line 30 as is the spacing of element 34 from fold line 30. This provides that when the cuff 36 is inverted to the alternate position shown in FIG. 5, the fastening elements 34 and 42 are properly aligned for fastening cooperation.

The seams 24 and 26 extend axially along the length of the sleeve 15 in generally parallel fashion, but at the lower ends of the sleeve 15 the seams 24 and 26 are so formed that they taper inwardly and downwardly toward each other as indicated at 24a and 26a. These inwardly directed seam segments 24a and 26a begin generally at about the level of the edge 38 of cuff 36 and extend through the width of cuff 36 down to edge fold 30. These inwardly tapering seams 24a and 26a serve as part of the means for tending to keep the cuff 36 in the two selected positions that are seen in FIGS. 3 and 5, so that when the cuff is in its inoperative position as seen in FIGS. 2 and 3, it tends to hug closely against the overlapped portion of back piece 22, and when the cuff is inverted to the operative position as seen in FIGS. 4 and 5, it tends to neatly close off the open lower end 28 of the tubular sleeve 15.

Figure 4:
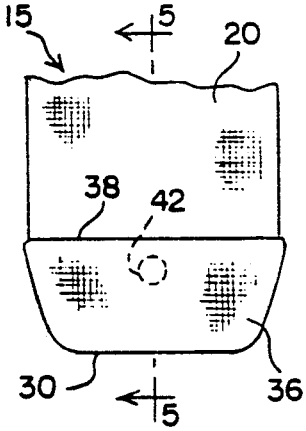
FIG. 4 is a simplified schematic front elevational view of the lower portion of the right pajama leg of FIG. 1, showing the bottom of the tubular sleeve in a relatively flat and extended configuration with the cuff of the open end of the sleeve inverted in order to enclose the foot of the child in a foot receiving enclosure or sock.
Figure 5:
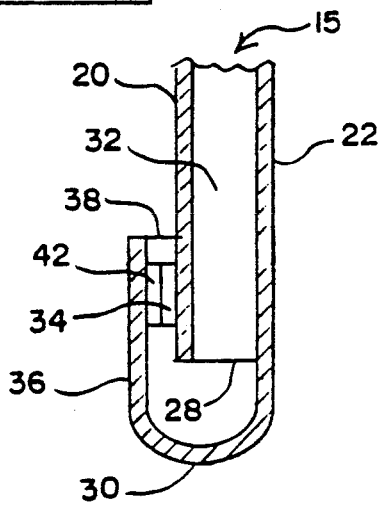
FIG. 5 is a simplified schematic cross-sectional elevational view of the convertible leg construction of FIG. 4, taken along the section line 5—5.

The fastening means 34 and 42 also cooperate to keep the cuff in the closed position as seen in FIGS. 4 and 5. While the fastening means are specifically shown in the form of circular discs 34 and 42, they may have any other configuration, such as a square or a rectangular shape. In any event, it is preferred that the fastening members 34 and 42 have congruent shapes.

Figure 6:
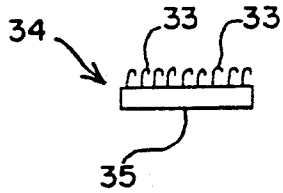
FIG. 6 shows one fastener element of a hook-and-loop type of fastener means where the element consists of a plurality of hooks upon a substrate base.
Figure 7:
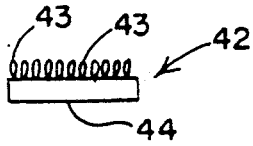
FIG. 7 shows the other fastener element of a hook-and-loop type of fastener means where the element consists of a plurality of loops upon a substrate base.

The actual structural shape of fastener means 34 and 42 is shown in FIGS. 6 and 7. FIG. 6 shows that fastening means 34 comprises a plurality of hook elements 33 supported on a base or substrate 35. FIG. 7 shows that fastening means 42 comprises a plurality of loop elements 43 supported on a base or substrate 44. When the elongated exterior cuff 36 is inverted so that the fastening means 34 and 42 are brought into face-to-face contact, as shown in FIGS. 4 and 5, a major portion of the plurality of hooks 33 will penetrate into the plurality of loops 43 so that a gripping engagement of fastener means 34 and 42 results, thereby securing the open end 28 of sleeve 15 in an enclosed state within the inverted cuff 36. The fastening means 34 and 42 shown in FIGS. 6 and 7 having the hook-and-loop structure are sometimes referred to as Velcro strips or Velcro closure elements. Those skilled in the art will recognize that the fastening means 34 and 42 comprise a hook-and-loop closure unit which is reversible. Thus, fastener means 34 could contain the loop elements instead of the hooks and fastener means 42 could contain the hook elements instead of the loops.

Those skilled in the art will readily perceive that the normal preschool child will have the mental and physical capability of inverting the elongated cuff 36 from the open position of FIGS. 2 and 3 to the closed position of FIGS. 4 and 5, by turning the cuff 36 inside out to bring the fastening element 42 into a face-to-face relationship with the fastening element 34. It is not necessary for the small child to bring the two fastening elements 34 and 42 into a totally congruent face-to-face relationship. Since the fastening element 34 contains a plurality of hook elements 33 and the fastening 42 contains a plurality of loop elements 43, the small child need only bring a portion of the hooks and loops into gripping engagement in order to enclose the open end 28 of the tubular sleeve 15.

Such a small child will find this type of a closing operation to be much simpler and more within his physical capabilities than attempting to close the end of the sleeve 15 by means of a button and buttonhole, or by making the enclosing movement secure by the gripping engagement of the two elements of a metal snap. Similarly, the small child can more easily open the closed end 28 (as seen in FIG. 5) by gripping the fabric of the inverted cuff 36 or the end 38 of the inverted cuff and pulling on the fabric of the cuff 36 or the end 38 to disengage the hooks and loops of the fastener elements 34 and 42. Thus, the small child has the physical ability and the psychic satisfaction to choose for himself whether he wishes to have his foot exposed to the atmosphere or enclosed with the sock-like structure 18 shown in FIG. 1.

Figure 8:
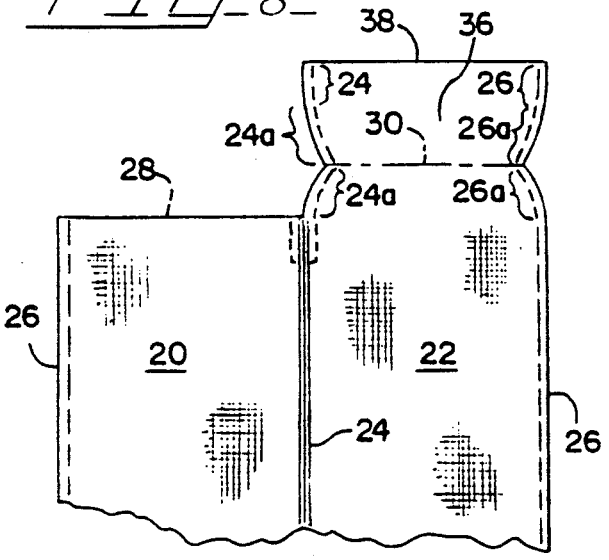
FIG. 8 is an inverted fragmentary view showing the layout of cut segments of cloth and sections thereof which, when sewn together, provide the improved convertible garment leg construction of the present invention.

The layout in FIG. 8 illustrates an intermediate condition of the assemblage of the elements of the convertible leg construction, and assists in understanding one method of forming the resulting elongated tubular sleeve 15 construction. As shown, portions of the front piece 20 and the rear piece 22 are illustrated prior to being folded and sewn. The inwardly inclined or tapered sections that are joined to define seam portions 24a and 26a are clearly shown in the layout of FIG. 8. In following through on the construction, the upper portion of rear panel 22 is designated to be cuff 36, and this panel 36 includes the free edge 38 which typically has a folded seam which is not shown. In order to form the tubular sleeve 15, panel 36 is folded down along fold line 30 so that cuff 36 now lies on the top of panel 22. Panel 20 is then folded along seam 24 so that it is over and lying upon the panel 22 and the cuff 36. Thus, the cuff 36 is then under panel 20 and lying upon panel 22. The seams 24a, 26a and 26 are then formed by stitching along the respective lines as illustrated by the broken lines in FIG. 8. After this, the sleeve 15 is pulled inside out so that the seamed portions 24 and 26 are located within the sleeve 15. From the foregoing description it will be evident to one skilled in the art as to how the sleeve construction of FIGS. 2 and 3 is sewn together.

Alternatively, the sleeve structure of FIGS. 2 and 3 can be fabricated as a substantially stitchless seamed or seamless structure by weaving techniques which are similar to those used in producing seamless socks and stockings, as well as nylon hosiery. Such techniques need not be discussed herein in detail.

Figure 9:
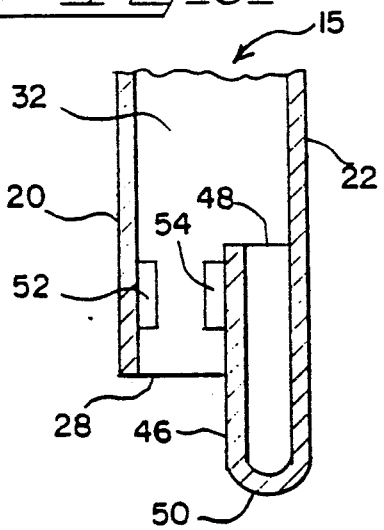
FIG. 9 discloses an alternative embodiment of the convertible garment leg construction of the present invention shown as a simplified schematic cross-sectional view, where the cuff and the fastener elements are contained within the internal space of the tubular fabric sleeve, with the bottom end opened to allow the child's foot to be exposed to the atmosphere.
Figure 10:
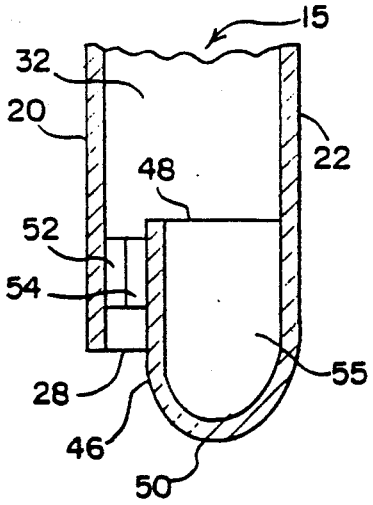
FIG. 10 is a simplified schematic cross-sectional view similar to that of FIG. 9, but showing the fastener elements in gripping engagement to close off the open end of the tubular sleeve in order to provide an end closure or sock for confining the foot of the child.

An alternate embodiment of the present invention is disclosed in FIGS. 9 and 10, where the cuff and the fastening elements are contained within the interior of the sleeve 15, which is in contrast to the foregoing embodiment of FIGS. 2–5, where the cuff and the fastening elements are on the outside of the sleeve. Referring now to FIG. 9 there is shown the second embodiment comprising the lower portion of the fabric sleeve 15 comprising the front panel 20 and the back panel 22. The extended portion of the back panel 22 is folded upwardly to provide the cuff 46 having a lower free terminus or edge fold 50. On the outside surface of the cuff 46 is a front fastening element 54 which is located proximate the upper free edge 48 of the interior cuff 46. Note that the outer surface of cuff 46 is inwardly facing, since it faces the interior space 32 between front panel 20 and rear panel 22, as clearly seen in FIG. 9. On the inside surface of the front panel 20 is the second fastening element 52. FIG. 9 discloses the structure of the second embodiment in an open configuration where the interiorally cuffed sleeve would be shirred up above the ankle of the child to expose the foot. FIG. 10 discloses the second embodiment in a closed configuration where the fastening elements 52 and 54 have been brought together in a gripping engagement, so that the interior space 32 of the tubular sleeve 15 is augmented by a foot receiving pocket 55 for the toes and forward portion of the foot. As seen in FIG. 10, the receiving pocket 55 is formed by the interior of the cuff 46.

Figure 12:
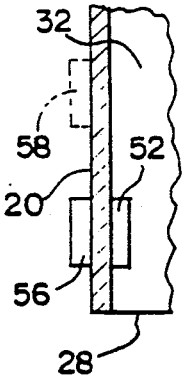
FIG. 12 is a simplified schematic cross-sectional view showing a portion of the front panel of the tubular sleeve where fastener elements are mounted on both the exterior and interior surfaces of the front panel.
Figure 11:
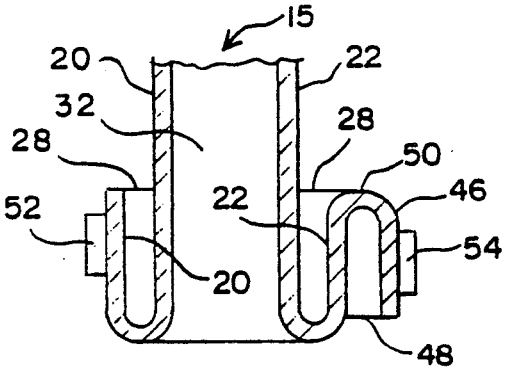
FIG. 11 is a simplified schematic cross-sectional view of the structure of FIG. 9 where the open end is inverted upwardly to provide an external cuff which completely surrounds the tubular fabric sleeve, thereby providing an open end of the sleeve which does not contain a cuff or fastener elements.
Figure 13:
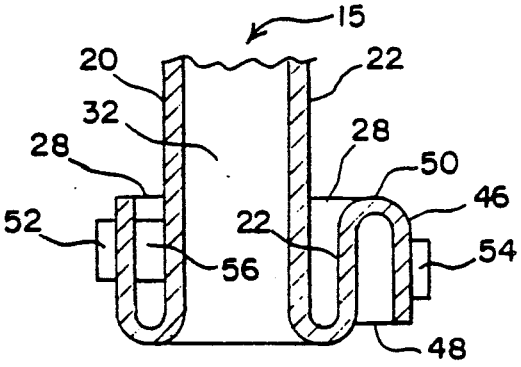
FIG. 13 is a simplified schematic cross-sectional view in accordance with FIG. 11, but showing the front panel of FIG. 12 having the interior and exterior fastener elements positioned on the folded back portion of the tubular sleeve so that the fastener element on the external surface of the front panel achieves gripping engagement with the outer surface of the front panel.

When the sleeve 15 is worn in the open position in a shirred condition above the ankle of the child, the fastening element 52 or 54 which contains the hook elements 33 will provide an exposed surface which can be very abrasive to the tender skin of the child's ankle or lower calf. Accordingly, when the sleeve 15 is in the open position according to FIG. 9, it is preferred to turn up the open end 28 of the sleeve so that an external completely encircling cuff is formed in accordance with the structure which is presented in FIG. 11. This moves both fastening elements 52 and 54 outside of the tubular sleeve 15 so they do not contact the skin of the child wearing the pajama leg. When the fabric of the tubular sleeve 15 is made of a stretchable or elastic fabric, the upwardly folded fabric structure of FIG. 11 will closely grip the ankle or lower leg of the child due to the elasticity of the stretchable fabric. In those constructions where the front panel 20 and the back panel 22 are not fabricated of a stretchable fabric, the circumferential cuff structure of FIG. 11 will tend to fall down. Accordingly, it is desirable or advantageous to place a third fastening element 56 on the outside surface of the front panel 20 as shown in FIG. 12. As seen in FIG. 12, the third fastening element 56 is positioned in a back-to-back relationship with fastening element 52. The third fastening element 56 has a plurality of gripping hooks so that when the open end of the tubular sleeve 15 is turned upwardly to form an external circumferential cuff according to FIG. 11, the hooks on the third fastening element 56 will come into a gripping contact with the outside surface of the front panel 20 as shown in FIG. 13. Although the gripping hooks of the fastening element 56 are designed to coact with loops on a corresponding fastening element 56 of looped structure, it has been found that the hooks on the gripping fastening element are sufficiently capable of adhering to the conventional fabric of a child's pajama so that no additional fastening element containing loops is typically necessary, although one may be provided on the front of panel 20 and above the hook fastening element 56, as shown in FIG. 12 as the phantom loop element 58, if so desired.

Figure 14:
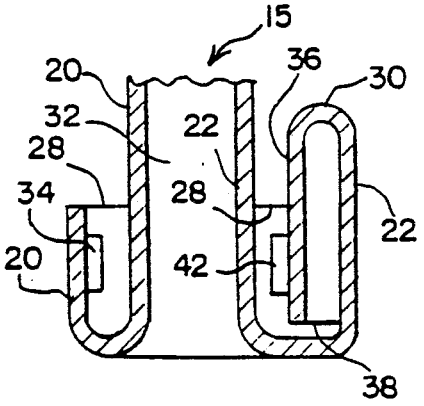
FIG. 14 is a simplified schematic cross-sectional view showing the embodiment of the convertible garment leg construction in accordance with FIG. 3 where the open end of the tubular fabric sleeve has been turned upwardly to define an external cuff completely surrounding the tubular sleeve and an unobstructed open lower end for the tubular sleeve.

In a similar manner, it is within the scope of the present invention to fold up the open end 28 of the tubular sleeve 15 in accordance with the first embodiment of FIGS. 2–5. When such an external circumferential cuff is formed by folding up the open end 28 of the FIG. 3 configuration, the structure of FIG. 14 will result. It is to be noted that no additional fastener element is required in order to hold up the circumferential cuff of FIG. 14. Since the fastening element 34 has hook elements on it, the fastening element 34 will grip the stretchable or non-stretchable fabric of the panel 20 on the external surface, as shown in FIG. 14, as soon as element 34 is pushed against panel 20. This cuff structure of FIG. 14 is most useful when the fabric of the panels 20 and 22 is a non-stretchable fabric.

It is to be noted that the second embodiment disclosed in FIGS. 9 and 10 is fabricated from the same fabric structure of FIG. 8, as is the first embodiment of FIGS. 2–5. The only difference is that when the panels 20 and 22, as well as the cuff 36, are stitched together to form the hems of FIG. 8, the resulting tubular sleeve is turned inside out to produce the embodiment of FIGS. 2 and 3, but it is left in its fabricated condition with the cuff 36 within the sleeve 15 to produce the embodiment of FIGS. 9 and 10. Other fabrication techniques, such as seamless weaving, will be readily understood by those skilled in the art.

Although the present invention has been described with preferred embodiments illustrated herein, it is to be understood that modifications and variations may be resorted to without departing from the spirit and scope of this invention. Such modifications and variations are considered to be within the purview and the scope of the appended claims.

The invention claimed is:

1. A convertible garment leg construction, suitable for use in a small child's pajamas, which comprises in combination:

a. a garment leg having an upper open end merged into a crotch and seat portion of a fabric garment, and having a lower open end spaced from said upper open end;

b. an elongated tubular fabric sleeve having an upper open end attached to the lower open end of said garment leg and having a lower open end spaced from said sleeve upper open end, having an elongated front fabric panel with side edges and having an elongated rear fabric panel with side edges, and having a length sufficient to provide a foot receiving sock element when the sleeve is extended to its full length;

c. an elongated fabric cuff on said sleeve lower open end partially within said sleeve, and extended across an inside surface of said rear panel of said sleeve, said cuff having an upper cuff edge above said sleeve lower open end and having a lower cuff edge fold below the sleeve lower open end;

d. a hook-and-loop type fastener unit having a first fastener element containing a plurality of loops and having a second fastener element containing a plurality of hooks for grippingly engaging said loops, one of said fastener elements being mounted on an inside surface of said sleeve front panel proximate said sleeve lower open end and the other one of said fastener elements being mounted on an inwardly facing outer surface of said cuff in a position across from said one of said fastener elements and located to provide that a wearer of said garment may manipulate said front panel and said cuff to bring said fastener elements into gripping engagement to close off said sleeve lower open end and provide said foot receiving sock element; and, e. a third fastener element containing a plurality of hooks mounted on an outside surface of said sleeve front panel, and positioned proximate said sleeve lower open end.

2. A convertible garment leg construction according to claim 1 wherein said sleeve and said cuff are made of a stretchable fabric which is at least circumferentially stretchable in a direction transverse of the longitudinal axis of said sleeve.

3. A convertible garment leg construction according to claim 1 wherein said sleeve and said cuff are made of a stretchable fabric which is at least circumferentially stretchable in a direction transverse of the longitudinal axis of said sleeve.

4. A convertible garment leg construction according to claim 1 wherein said front panel and said rear panel are separate elongated pieces of fabric joined at longitudinal edge seams to provide said elongated tubular fabric sleeve.

5. A convertible garment leg construction according to claim 4 wherein said cuff is an extension of said rear panel folded back upon itself to provide said lower cuff edge fold.

6. A convertible garment leg construction according to claim 5 wherein said cuff has longitudinal side edges attached to said sleeve at edge seams that are extensions of the longitudinal edge seams joining said front and rear panels.

7. A convertible garment leg construction according to claim 6 wherein said longitudinal side edges and edge seams of said cuff extend axially of the sleeve and taper inwardly from said upper cuff edge to said lower cuff edge fold.

8. A convertible garment leg construction according to claim 1 wherein said upper cuff edge has a length extending about one half of the circumferential periphery of said sleeve.

9. A convertible garment leg construction according to claim 1 wherein a fourth fastener element containing a plurality of loops is mounted on the outside surface of said front panel spaced from and above said third fastener element for gripping engagement with said third fastener element when said sleeve lower open end is turned up to form a circumferential outer cuff around the sleeve.

10. A convertible garment leg construction according to claim 1 wherein said third fastener element is positioned on the outside surface of said sleeve front panel in a back-to-back relationship with said one of said fastener elements which is mounted on the inside surface of said sleeve front panel.

11. A convertible garment leg construction, suitable for use in a small child's pajamas, which comprises in combination:

a. a garment leg having an upper open end merged into a crotch and seat portion of a fabric garment, and having a lower open end spaced from said upper open end, and said garment leg further having an elongated front fabric panel with side edges and having an elongated rear fabric panel with side edges, and having a length sufficient to provide a foot receiving sock element when the garment leg is extended to its full length;

b. an elongated fabric cuff on said lower open end, partially within said garment leg, and extended across an inside surface of said rear panel, said cuff having an upper cuff edge above said lower open end and having a lower cuff edge fold below the lower open end;

c. a hook-and-loop type fastener unit having a first fastener element containing a plurality of loops and having a second fastener element containing a plurality of hooks for grippingly engaging said loops, one of said fastener elements being mounted on an inside surface of said front panel proximate said lower open end and the other one of said fastener elements being mounted on an inwardly facing outer surface of said cuff in a position across from said one of said fastener elements and located to provide that a wearer of said garment may manipulate said front panel and said cuff to bring said fastener elements into gripping engagement to close off said lower open end and provide said foot receiving sock element; and, e. a third fastener element containing a plurality of hooks mounted on an outside surface of said front panel, and positioned proximate said lower open end.

12. A convertible garment leg construction according to claim 11 wherein said panels and said cuff are made of a stretchable fabric which is at least circumferentially stretchable in a direction transverse of the longitudinal axis of said leg.

13. A convertible garment leg construction according to claim 11 wherein said panels and said cuff are made of a stretchable fabric which is at least circumferentially stretchable in a direction transverse of the longitudinal axis of said leg.

14. A convertible garment leg construction according to claim 11 wherein said front panel and said rear panel are separate elongated pieces of fabric joined at longitudinal edge seams.

15. A convertible garment leg construction according to claim 14 wherein said cuff is an extension of said rear panel folded back upon itself to provide said lower cuff edge fold.

16. A convertible garment leg construction according to claim 15 wherein said cuff has longitudinal side edges attached to said leg at edge seems that are extensions of the longitudinal edge seams joining said front and rear panels.

17. A convertible garment leg construction according to claim 16 wherein said longitudinal side edges seams of said cuff extend axially of the leg and taper inwardly from said upper cuff edge to said lower cuff edge fold.

18. A convertible garment leg construction according to claim 11 wherein said upper cuff edge has a length extending about one half of the circumferential periphery of said leg.

19. A convertible garment leg construction according to claim 11 wherein a fourth fastener element containing a plurality of loops is mounted on the outside surface of said front panel spaced from and above said third fastener element for gripping engagement with said third fastener element when said garment leg lower open end is turned up to form a circumferential outer cuff around said leg.

20. A convertible garment leg construction according to claim 11 wherein said third fastener element is positioned on the outside surface of said front panel in a back-to-back relationship with said one of said fastener elements which is mounted on the inside surface of said front panel.

21. A convertible garment leg construction, suitable for use in a child's pajamas, which comprises in combination a garment leg having an open bottom end, elongated front and rear panels of stretchable material joined at longitudinal edge seams to provide an elongated tubular sleeve having a first open end that is attached to said garment leg open bottom end and is circumferentially stretchable in a direction transverse of said longitudinal edge seams, the length of the sleeve being such as to provide a foot receiving sock element at a second sleeve open end spaced from said first sleeve open end when the sleeve is extended to its full length, the second open end of the sleeve defining thereon an elongated cuff located partially within the sleeve across an inside surface of said rear panel and having one transverse folded edge thereof integral with said rear panel, the cuff having longitudinal side edges attached to spaced portions of the sleeve at seams that are extensions of the said longitudinal edge seams, said longitudinal side edges and seams of the cuff extending axially of the sleeve and tapering inwardly from an upper free edge of the cuff to the folded edge of the cuff that is integral with the rear panel, said seam lines at the side edges of the cuff being spaced from each other so as to provide that the elongated cuff is stretchable with the circumferentially stretchable sleeve, the length of the free edge of the cuff extending along substantially one-half of the circumferential periphery of the sleeve, the cuff being manipulatable between a first, stored-away position in which it is adjacent the interior of the sleeve so as not to obstruct the second open end of the tubular sleeve and so as to permit the stretchable sleeve and cuff to contract to form a neat anklet-cuffing for the garment leg, and a second sleeveclosing position where the cuff extends across the second open end of the sleeve to close same, a hook-and-loop type fastener unit having a first fastener element containing a plurality of loops and having a second fastener element containing a plurality of hooks for grippingly engaging said loops, one of said fastener elements being mounted on an inside of said sleeve front panel proximate said second open end of the sleeve and the other one of said fastener elements being mounted on an inwardly facing outer surface of said cuff in a position across from said one of said fastener elements and located to provide that a wearer of said garment may manipulate said front panel and said cuff to bring said fastener elements into gripping engagement to close off said sleeve second open end and provide said foot receiving sock element, and a third fastener element containing a plurality of hooks mounted on an outside surface of said sleeve front panel, and positioned proximate said sleeve second open end.

22. A convertible garment leg construction according to claim 21 wherein said third fastener element is positioned on the outside surface of said sleeve front panel in a back-to-back relationship with said one of said fastener elements which is mounted on the inside surface of said sleeve front panel.

23. A convertible garment leg construction according to claim 21 wherein a fourth fastener element containing a plurality of loops is mounted on the outside surface of said front panel spaced from and above said third fastener element for gripping engagement with said third fastener element when said sleeve second open end is turned up to form a circumferential outer cuff around the sleeve.

24. A convertible garment element construction, suitable for use in a small child's pajamas, which comprises in combination:

a. a tubular garment element having an upper open end merged into a body portion of a fabric garment, and having a lower open end spaced from said upper open end, and said tubular garment element further having an elongated front fabric panel and an elongated rear fabric panel, and having a length sufficient to provide a limb appendage receiving cover element for a wearer of the garment when the tubular garment element is extended to its full length;

b. an elongated fabric cuff on said lower open end, partially within said tubular garment element, and extended across an inside surface of said rear panel, said cuff having an upper cuff edge above said lower open end and having a lower cuff edge fold below the lower open end;

c. a fastener unit having a first fastener element containing a first gripping structure and having a second fastener element containing a second gripping structure for matingly engaging said first gripping structure, said first fastener element being mounted on an inside surface of said front panel proximate said lower open end and said second fastener element being mounted on an inwardly facing outer surface of said cuff in a position across from said first fastener element and located to provide that the wearer of said garment may manipulate said front panel and said cuff to bring said first and second fastener elements into gripping engagement to close off said lower open end and provide said limb appendage receiving cover element; and, d. a third fastener element mounted on an outside surface of said front panel and containing a gripping structure identical to one of said first and second gripping structures.

25. A convertible garment element construction according to claim 24 wherein said third fastener element mounted on the outside surface of said front panel is in a back-to-back relationship with said first fastener element which is mounted on the inside surface of said front panel.

26. A convertible garment element construction according to claim 24 wherein a fourth fastener element containing the other of said first and second gripping structures is mounted on the outside surface of said front panel spaced from and above said third fastener element for gripping engagement with said third fastener element when said tubular garment element lower open end is turned up to form a circumferential outer cuff around said tubular garment element.

27. A connvertible garment element construction according to claim 26 wherein said third fastener element mounted on the outside surface of said front panel is in a back-to-back relationship with said first fastener element which is mounted on the inside surface of said front panel.

* * * * *

UNITED STATES PATENT AND TRADEMARK OFFICE

CERTIFICATE OF CORRECTION

PATENT NO. : 5,067,179

DATED : November 26, 1991

INVENTOR(S) : Walter S. Wormser

It is certified that error appears in the above-identified patent and that said Letters Patent is hereby corrected as shown below:

Column 7, line 32, after "element" delete "56"; line 34, after "element" insert -- 56 --.

Column 10, line 18, the term "seems" should read -- seams --.

Column 10, line 22, after "edges" insert -- and edge --.

Column 11, line 8, "sleeveclosing" should read -- sleeve-closing --.

Signed and Sealed this

Thirteenth Day of April, 1993

*Attest:*

STEPHEN G. KUNIN

*Attesting Officer*

*Acting Commissioner of Patents and Trademarks*